US005875283A

United States Patent [19]

Yane et al.

[11] Patent Number: 5,875,283

[45] Date of Patent: Feb. 23, 1999

[54] PURGED GROUNDED IMMERSION HEATER

[75] Inventors: Daryl J. Yane, Kent; Howard J. Base, Macedonia, both of Ohio

[73] Assignee: Lufran Incorporated, Streetsboro, Ohio

[21] Appl. No.: 948,688

[22] Filed: Oct. 10, 1997

Related U.S. Application Data

[60] Provisional application No. 60/027,920 Oct. 11, 1996.

[51] Int. Cl. [6] ..... H05B 3/04

[52] U.S. Cl. ..... 392/497; 392/488; 219/523; 219/544; 338/214

[58] Field of Search ..... 392/488–490, 392/497, 498, 501, 503, 491; 219/523, 549, 544; 338/214, 234

[56] References Cited

U.S. PATENT DOCUMENTS

| | | | |
|---|---|---|---|
| 1,480,922 | 1/1924 | Weydell | 392/488 |
| 2,859,327 | 11/1958 | Kaminsky | 392/488 |
| 3,576,694 | 4/1971 | Greisman | 392/488 |
| 3,846,616 | 11/1974 | Beck | 392/487 |
| 3,898,428 | 8/1975 | Dye | 392/489 |
| 4,158,764 | 6/1979 | Yane . | |
| 4,390,776 | 6/1983 | Yane et al. . | |
| 4,531,049 | 7/1985 | Sato . | |
| 4,551,619 | 11/1985 | Lefebvre . | |
| 4,553,024 | 11/1985 | Findlay . | |
| 5,109,473 | 4/1992 | Rezabek et al. . | |
| 5,155,800 | 10/1992 | Rezabek et al. . | |
| 5,394,507 | 2/1995 | Okamoto | 392/480 |
| 5,558,794 | 9/1996 | Jansens . | |
| 5,586,214 | 12/1996 | Eckman . | |

FOREIGN PATENT DOCUMENTS

| | | |
|---|---|---|
| 251127 | 12/1966 | Austria . |
| 2599479 | 12/1987 | France . |
| 1095417 | 12/1960 | Germany . |
| 1299835 | 7/1969 | Germany . |

OTHER PUBLICATIONS

Page from Lufran catalog entitled "Reliable Heating/Cooling Equipment for the Metal Finishing Industry" (Form RHC/1194).

Page from Lufran catalog entitled "Nine Element over the Side Teflon Immersion Heaters".

Two pages from Lufran catalog entitled "Why Purge?" (Form LP892).

Two pages from Lufran catalog entitled "6TFM Over–the–Side Teflon Heater 6 Element" (Form 6TFM693).

Article entitled "Solving the Teflon–Permeation Problem" from Process Heating publication of Business News Publishing Co. (Sep./Oct. 1994 issue).

*Primary Examiner*—John A. Jeffery

*Attorney, Agent, or Firm*—Fay, Sharpe, Beall, Fagan, Minnich & McKee

[57] ABSTRACT

An immersion heater for corrosive fluids includes an electrically resistive material strand operative upon connection to a source of power to provide heat. A thermally conductive electrically insulating fill material is disposed around the electrically resistive material strand. An electrically conductive sheath encases the fill material. A tubular jacket of a flexible chemically inert material encases the electrically conductive sheath. A fluid flow passage is defined between the tubular jacket and the sheath for allowing a fluid to flow therethrough. The fluid is a purge gas that flows between the sheath and the jacket in order to remove any corrosive fluid which may have penetrated the jacket. A method for manufacturing an immersion heater is also disclosed.

14 Claims, 3 Drawing Sheets

PURGED GROUNDED IMMERSION HEATER

BACKGROUND OF THE INVENTION

This application bases its priority on provisional application Ser. No. 60/027,920 filed on Oct. 11, 1996.

The present invention relates to immersion heaters for heating a liquid in a bath. More particularly, the invention relates to a grounded gas purged immersion heater.

Tubular electric heating elements are known in the art to consist of a resistance wire coil or ribbon wound in such a way as to provide an exact electrical resistance for a given length of coil. The coil is generally inserted into a sheath, usually a tube made of metal, and filled with an electrically insulating material, such as magnesium oxide. The assembly is then roll reduced or swaged to compact the fill material and eliminate any voids within the assembly so as to facilitate heat transfer. The entire structure is then annealed to eliminate stresses built up during roll reduction. The finished heating element can then be formed into an unlimited variety of shapes or configurations as needed for the process requiring heat.

It is also known in the art that watt densities or the amount of heat which can be transferred from a given length of tubular heating element varies depending upon the process for which the heater element is used. As an example, an oil based liquid transfers heat much more slowly than does a water based liquid. Since the resistance wire must stay well below its melting point to provide economical, useful life, the amount of power (or watts) for a unit area must be varied. A common "watt density" known in the art for heating an oil type liquid is 20 watts per square inch of heater sheath area. For a water based liquid, watt densities can be as high as 90 watts per square inch.

From the above, it is evident that for any given application, a certain amount of material must be used to achieve the proper watt density. Therefore, it would be beneficial if one could use less material to provide an equivalent amount of surface area. If this were done, a cost saving would be achieved.

Many shapes have been used for tubular heater sheaths. It is common in the art to use triangular, oval or even flat surfaces on the sheaths in order to increase heater efficiencies. Protrusions along the heater sheath, such as fins, splines or pins, have also been used and work very well for certain applications. Each of the shapes described, however, has specific limitations. Flat and oval sheaths lack the ability to maintain sufficient compacting of the fill material. This in turn can produce voids within the heater element thus limiting heat transfer. Fins and other protrusions increase the amount of surface area but also require additional manufacturing steps, as well as additional material. Both of these increase costs. It would be desirable to increase the surface area of a tubular heating element without adding material or requiring additional shaping.

Electrical resistance heaters formed of a continuous flexible cable are particularly suitable for immersion in corrosive chemical baths since the exterior of the flexible cable may be jacketed with a suitable plastic material having satisfactory resistance to the corrosive nature of the chemical bath being heated. An example of a flexible cable resistance heater is shown and described in U.S. Pat. No. 4,158,764. This patent is incorporated herein by reference in its entirety.

It is known to provide such flexible cable heaters with an outer casing or jacket formed of a polytetrafluoroethylene (PTFE) material. PTFE has satisfactory resistance to chemical attack by corrosive media. However, it has the disadvantage that when employed in a thin walled tube for desired flexibility, the permeability of PTFE permits transmigration of heated chemical vapor into the interior of the cable heater. To overcome this problem, U.S. Pat. No. 4,553,024 discloses that the outer jacket of the cable-type immersion heater can be connected to a suitable source of a dry gaseous medium for circulation from an inlet end of the heater cable through the interior thereof, and over the heating element, to an exhaust at the other end of the heater cable. This provides a continuous dry gas flow or purge over the resistance heating element to scavenge any accumulated corrosive chemical vapors which may have permeated through the outer plastic jacket of the heater cable. Pat. No. 4,553,024 is also incorporated herein by reference in its entirety.

One of the difficulties with the flexible cable heaters illustrated in U.S. Pat. Nos. 4,158,764 and 4,553,024 is that the heaters are not grounded. Such grounding is required by various regulatory authorities, such as Underwriters Laboratories (UL) and the Canadian Standards Association (CSA) in order to be approved. It would also be desirable to have a gas purge take place on such grounded flexible cable heaters while maintaining good heat transfer through the PTFE jacket of the cable heater.

Accordingly, it has been considered desirable to develop a new and improved heater sheath element which can be used in a purged grounded fluid heater to meet the above-stated needs and overcome the foregoing difficulties and others while providing better and more advantageous overall results.

BRIEF SUMMARY OF THE INVENTION

In accordance with the present invention, a new and improved immersion heater for corrosive fluids is provided.

More particularly in accordance with this aspect of the invention, the heater comprises an electrically resistive material strand operative upon connection to a source of power to provide heat. A thermally conductive electrically insulating fill material is disposed around the electrically resistive material strand. An electrically conductive sheath is disposed around the fill material. A tubular jacket of a flexible chemically inert material encases the electrically conductive sheath. A fluid flow passage is defined between the tubular jacket and the sheath for allowing a fluid to flow therethrough.

In one embodiment, a knurled pattern, comprising sets of first and second helically extending channels which spiral in opposite directions, is provided on the outer surface of the electrically conductive sheath to allow for a purge fluid to flow over the outer surface of the sheath and between the sheath and the jacket in order to remove any corrosive fluid which may have penetrated the jacket. In another embodiment, a tubular jacket is provided with a series of spaced internally extending ribs which contact the outer surface of the sheath. The valleys between the ribs cooperate with the outer surface of the sheath to form channels through which a purge fluid can flow. In yet another embodiment, a braid material is disposed between the sheath and the tubular jacket in order to form fluid flow channels for the purge fluid.

In accordance with another aspect of the present invention, an immersion heating apparatus is provided.

More particularly in accordance with this aspect of the invention, the apparatus comprises a flexible type immersion heater for immersion in a corrosive fluid. The immersion heater comprises an electrically resistive material strand operative upon connection to a source of power to provide heat and a thermally conductive electrically insulating fill material disposed around the electrically resistive material strand. An electrically conductive sheath is disposed around the fill material. A tubular jacket of a flexible chemically inert material encases the electrically conductive sheath. A fluid flow passage is defined between the tubular jacket and the sheath to allow a fluid to flow therethrough. A source of purged fluid medium is provided and a conduit is also provided for connecting the source of purged fluid medium to the fluid flow passage.

In accordance with still another aspect of the present invention, a method is provided for manufacturing an immersion heater for corrosive fluids.

In accordance with this aspect of the invention, the method comprises the steps of providing an electrically resistive material strand and a tubular sheath of an electrically conductive material. The strand is inserted into the sheath. A thermally conductive electrically insulating material is packed between the strand and the sheath in order to isolate the strand from the sheath. Any voids in the fill material located in the sheath are removed. A tubular jacket of a chemically inert material is slipped over the sheath. A channel is formed between an outer periphery of the sheath and an inner periphery of the jacket.

One advantage of the present invention is the provision of a new and improved purged grounded liquid heater element.

Another advantage of the present invention is the provision of a heater element with an electrically conductive sheath for grounding and a chemically inert outer covering or jacket wherein flow channels are formed between the sheath and the covering to allow a purge fluid to flow therebetween.

Still another advantage of the present invention is the provision of a technique for increasing the surface area of a tubular sheath without adding additional material or needing additional manufacturing steps.

Yet another advantage of the present invention is the provision of a heater element sheath which is provided with integral flow channels while maintaining the structural integrity of the sheath because no material is removed from the sheath.

An additional advantage of the present invention is the provision of a heater element sheath with an increased heating efficiency but which sheath is capable of being readily compacted so as to eliminate any voids in a fill material held within the sheath.

A further advantage of the present invention is the provision of a heater element having a tubular jacket provided with internally extending ribs. The ribs cooperate with an outer surface of a heater element sheath to define fluid flow channels to allow a purge fluid to flow therethrough.

A still further advantage of the present invention is the provision of a heater element including a heater element sheath, a tubular jacket and a braided sleeve of material disposed between the sheath and the jacket. The braided sleeve cooperates with the inner surface of the jacket and the outer surface of the sheath to define flow channels for a purge fluid to flow therethrough.

A yet further advantage of the present invention is the provision of a heater element which allows for monitoring the integrity of the outer chemically resistant tubular jacket by measuring either loss of flow or loss of pressure, if no flow is desired.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts preferred embodiments of which will be described in detail in this specification and illustrated in the accompanying drawings which form a part hereof and wherein.

DETAILED DESCRIPTION OF THE PREFERRED EMBODIMENT

Figure 1:
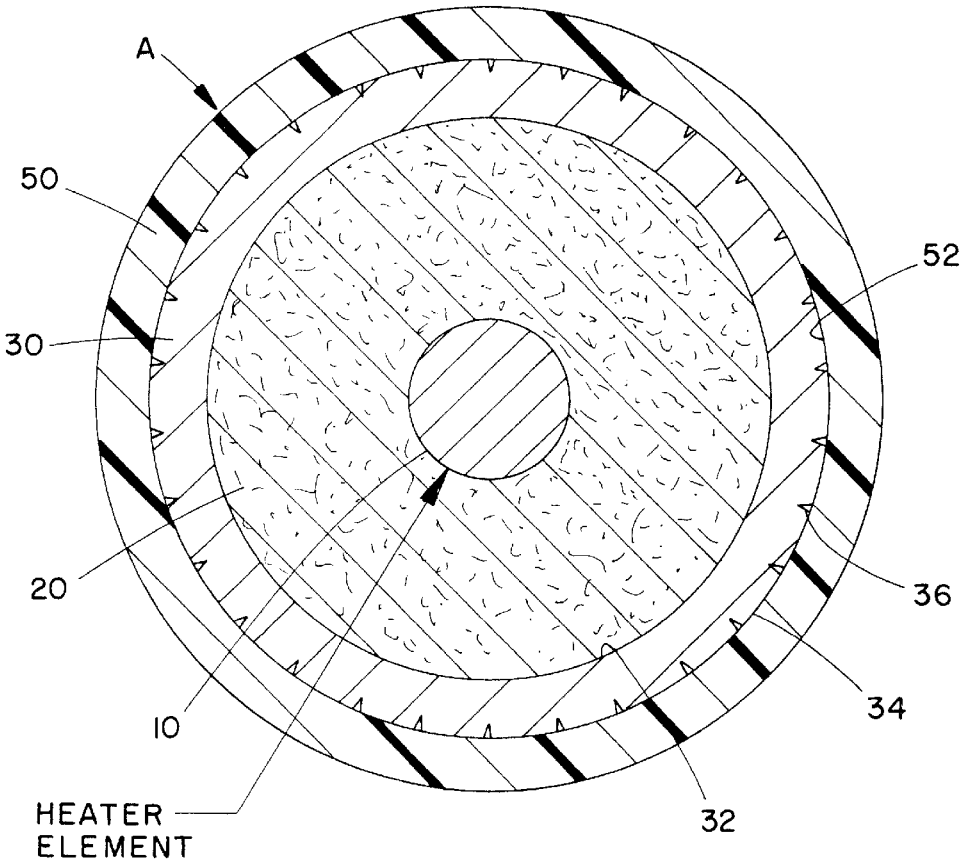
FIG. 1 is a cross-sectional view through a gas purged flexible cable type immersion heater according to a first preferred embodiment of the present invention.

Referring now to the drawings wherein the showings are for purposes of illustrating preferred embodiments of the invention only and not for purposes of limiting same, FIG. 1 illustrates a heater cable A according to a first preferred embodiment of the present invention. The cable comprises a heater element 10 which can be a conventional cylindrical heater wire. The heater wire is surrounded by a fill material 20. The fill material is an electrically insulating thermally conductive material. Preferably, the material comprises magnesium oxide or another conventionally known such material.

Enclosing the fill material is a conductive, sheath 30, preferably made from a conventional deformable metal. The sheath includes an inner periphery 32 which contacts the fill material 20 and an outer periphery 34. Located in the outer periphery are a plurality of grooves 36.

Figure 3:
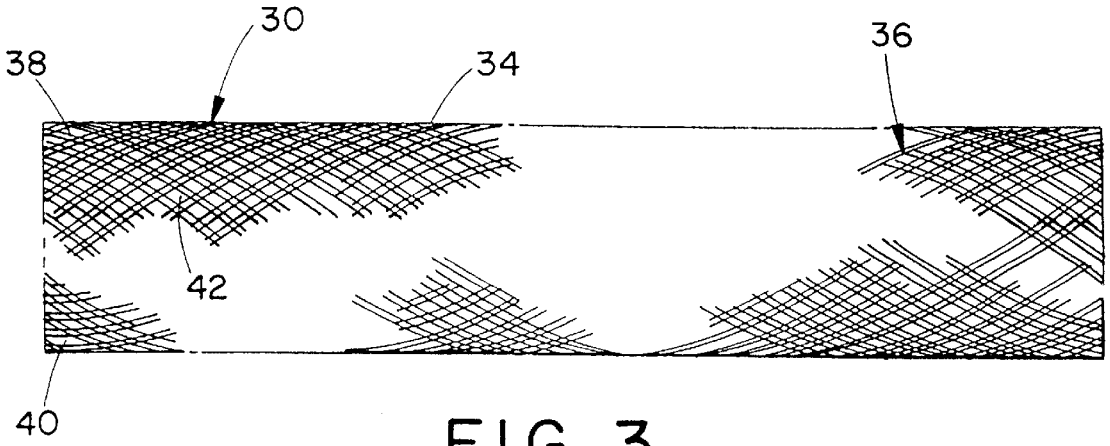
FIG. 3 is a side elevational view on a reduced scale of the heater sheath of FIG. 1.

With reference now also to FIG. 3, the grooves comprise a series of parallel helically spiralling left hand grooves 38 and a series of parallel helically spiralling right hand grooves 40. The two sets of grooves intersect at a number of locations around the outer periphery 34 of the sheath 30 to form a plurality of diamond-shaped islands 42. In essence, a knurled pattern is provided on the outer periphery 34 of the sheath 30.

The knurled pattern can be manufactured by using a conventional set of dies during final roll reduction of the sheath element 30 so as to compact the fill material 20 and remove any voids within the heater element. Such voids are undesirable since they limit heat transfer. The method of producing this knurled pattern does not remove any material from the sheath 30 and thereby maintains the structural integrity of the tubular element. The knurled pattern can be produced by using conventional dies and allows for increased cost savings. It has been found that the knurled pattern provides an increase in surface area of the sheath of approximately 17%.

While a knurled pattern is illustrated in FIG. 3, it should be appreciated that a variety of other patterns can be produced on the outer periphery of the sheath by using other types of conventional dies. All that is necessary is that the sheath be so formed as to provide a plurality of longitudinally extending flow channels in the outer surface of the sheath while maintaining a sufficient amount of sheath surface area for conductive heat transfer to a casing 50.

After the knurled pattern has been formed in the sheath 30, the casing or jacket 50 can be slipped over the sheath 30. An inner periphery 52 of the casing 50 contacts the several islands 42 of the sheath 30 in order to enhance heat transfer. An outer periphery 54 of the casing 50 is in contact with the solution which is to be heated.

As is known, one end of the tubular casing 50 can be expanded mechanically and the heater element can be forced into the casing. This method provides a tighter fit than even directly extruding of the casing onto the sheath. The casing is preferably made from a suitable chemically inert thermoplastic material, such as polytetrafluoroethylene sold under the brand name TEFLON.

Preferably the sheath 30 is made of a suitable conventional metal. When the heater cable A is used to heat a corrosive type liquid, such as deionized water or another type of liquid used in the manufacture of e.g., computer chips, the sheath 30 is preferably made of a suitable corrosion resistant material, such as stainless steel, titanium, incaloy or copper. For other types of applications, other types of metals such as zirconium or columbium can be employed.

Figure 4:
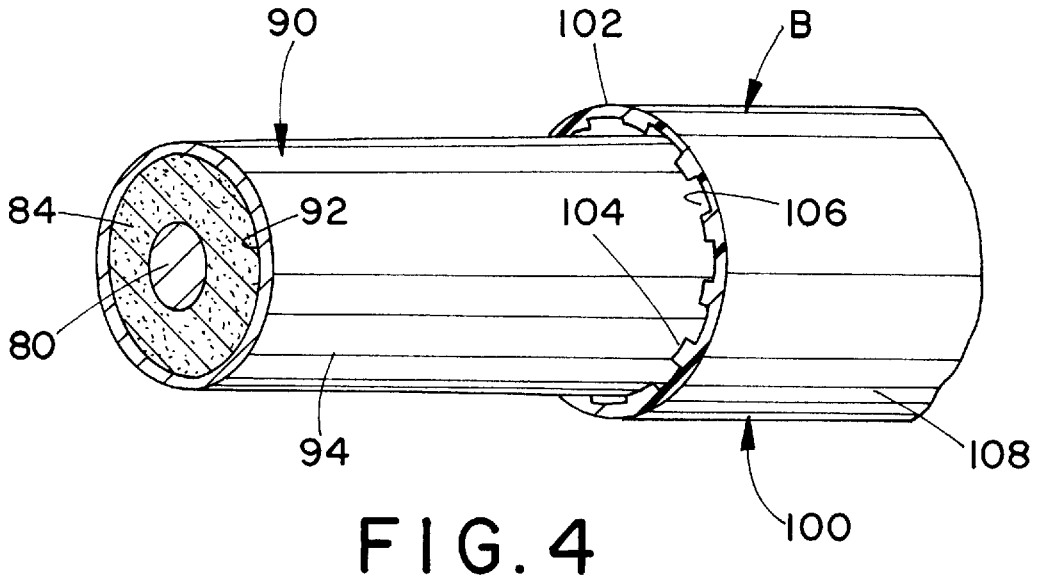
FIG. 4 is a perspective view of a gas purged flexible cable type immersion heater according to a second preferred embodiment of the present invention.

With reference now to FIG. 4, a heater cable B according to a second preferred embodiment of the present invention is there illustrated. The heater cable comprises a heater element 80 which can be a conventional cylindrical heater wire that is surrounded by a known fill material 84. Enclosing the fill material is a conductive sheath 90, preferably made from a conventional metallic material. The sheath includes an inner periphery 92 which contacts the fill material 84 and an outer periphery 94.

A casing or jacket 100 encloses the sheath 90. In this embodiment, the casing includes an inner periphery 102 on which there are provided a plurality of spaced longitudinally extending ribs 104. Defined between the ribs are respective valleys 106. Since the ribs 104 contact the outer periphery 94 of the sheath 90, the valleys 106 can serve as longitudinally extending flow channels for a purge fluid which flows through the jacket 100. An outer periphery 108 of the jacket 100 is in contact with the solution which is to be heated. As in the previous embodiment, the heater element sheath 90 can be forced into the jacket 100. Alternatively, the jacket 100 can simply be pulled over the sheath 90. Also, if desired, the jacket 100 could be extruded over the sheath.

Figure 5:
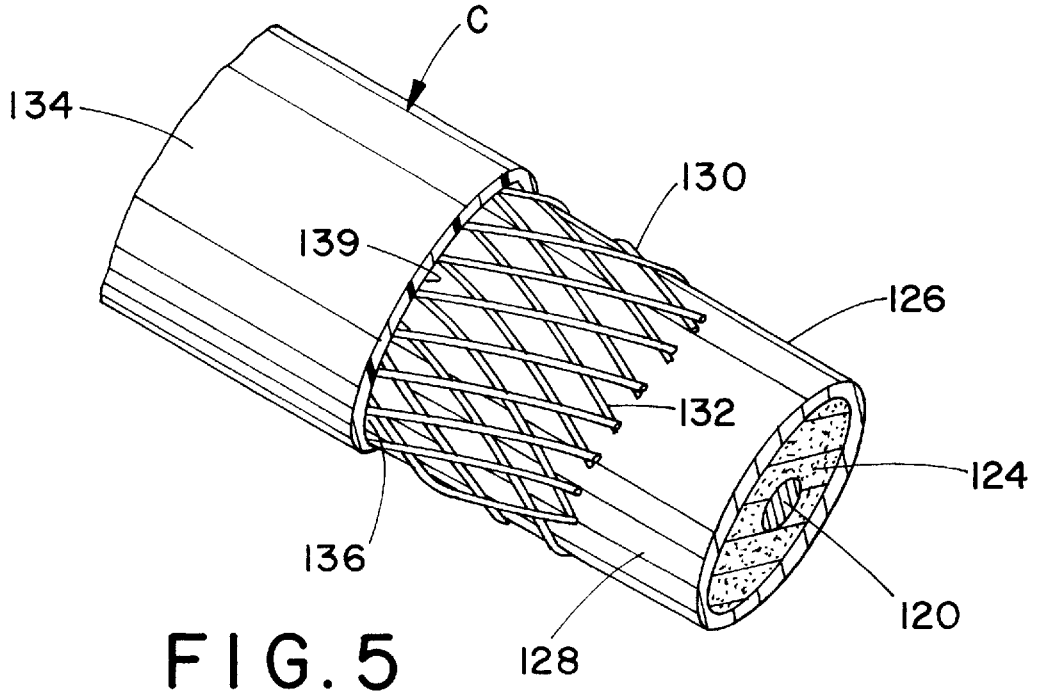
FIG. 5 is a perspective view through a gas purged flexible cable type immersion heater according to a third preferred embodiment of the present invention.

With reference now to FIG. 5, a heater cable C according to a third preferred embodiment of the present invention is there illustrated. In this embodiment, the cable comprises a heater element 120, preferably in the form of a conventional wire which is surrounded by a known fill material 124. Enclosing the fill material is a conductive sheath 126 made from a suitable known metal. The sheath has an outer periphery 128 which is contacted by a braid layer 130. The braid layer can comprise one or more strands 132 of a suitable conventional strand material. Enclosing the braid is a tubular jacket 134. The jacket has an inner surface 136 which contacts an outer surface of the braid layer 130 while the inner surface of the braid layer contacts the outer surface 128 of the sheath 126. Formed by a cooperation of the jacket 134, braid 130 and sheath 126 are a plurality of flow channels 140 which allow a purge fluid to flow therethrough. As in the previous embodiments, the jacket 134 can be pulled over the remaining elements of the heater. Alternatively, the jacket can simply be extruded over such elements.

The braid layer can be made of any suitable conventional material, whether it is thermoplastic or metallic strand material. The only requirement is that the material be capable of accommodating and transmitting high temperatures. Another material which may be suitable for this purpose would be an insulating glass or quartz material.

Figure 2:
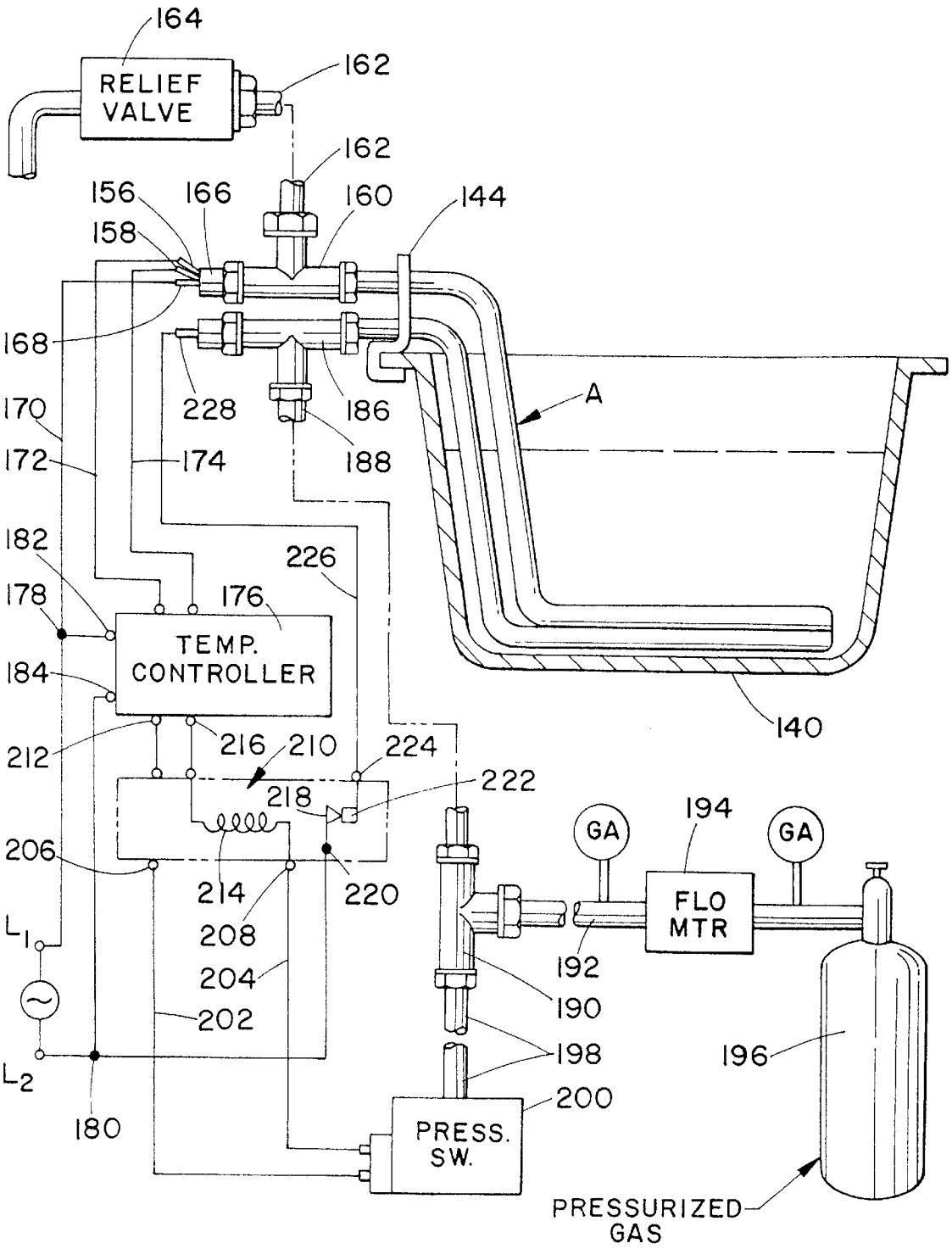
FIG. 2 is a schematic view of a heater cable installation in a system for heating liquid in an open vat.

With reference now to FIG. 2, the heater cable A can be employed in an open liquid container 140. The heater cable is shown to be immersed in a liquid held in the container 140. The flexible heater cable A has its ends extending out of the liquid bath and through a suitable mounting arrangement 144 provided on the rim of the container.

There is a conventional thermocouple which can extend into the heater cable A to allow for sensing of an overheating condition to prevent the melting of the thermoplastic casing 50. The thermocouple has a pair of leads 156, 158 which extend longitudinally through the heater cable A and longitudinally outward of the casing 50. The casing 50 is connected to a tee 160 to make pressure tight connection. One branch of the tee 160 is connected to a pressure fitting tubing 162 connected to the inlet of a pressure relief valve 164. The other branch of the tee 160 is closed by a pressure type fitting tubing 162 connected to the inlet of a pressure relief valve 164. The other branch tee 160 is closed by a pressure tight fitting and resilient grommet 166 and has one power lead 168 of the heater cable extending therethrough and connected via lead 170 to one side Li of the power line. The thermocouple leads 156, 158 also extend through grommet 166 and are connected via leads 172, 174 to the input terminals of a temperature controller 176. The controller, in turn, is connected via a junction 178 to one side of power line Li and via junction 180 to the other side L2 of the power line through controller terminals 182 and 184.

The opposite end of the heater cable A is connected to a bracket 144 and has suitable pressure type fittings connected to a conduit tee 186 which has one branch thereof connected to a flexible tube 188 which is connected to a tee fitting 190. One branch of tee 190 is connected to a fluid conduit 192 to the outlet of meter 194 which receives a pressurized, gaseous medium from a reservoir 196. The remaining branch of tee 190 is connected to a fluid pressure fitting tube 198 which is in fluid contact with a sensing cavity of a pressure switch 200.

The gaseous fluid supply 196 is connected to provide a supply of purged gas through tee 190, tubing 188 and tee 186 through the cable heater 142 and thus, through relief valve 164 to thereby provide a continuous gas purge between the inner periphery 52 of the casing and the outer periphery 34 of the sheath 30.

The pressure switch 200 is connected electrically in series via leads 202, 204 to terminals 206, 208 of a relay indicated generally at 210. Terminal 206 of the relay is connected to one signal output terminal 212 of the temperature controller 176. Terminal 208 is connected through relay coil 214 to terminal 216 of the temperature controller.

The relay coil 214 has an armature operably connected to a movable switch contact member 218 connected to junction 220. The stationary contact 222 of relay 210 is connected to terminal 224 and lead 226 to a heater power lead 228 out of tee 186.

In operation, the temperature controller 176 energizes the relay coil 214, and closes contacts 218, 222. Coil 214 is thereby energized. In the event that a break or leak in the casing 50 occurs permitting loss of the gaseous medium, the decrease in the gas purge is sensed by a pressure switch 200. This breaks the circuit in relay coil 214 thereby de-energizing the coil and opening switch contacts 218, 222 to turn off power to the heater cable. In the event that there is a loss of liquid in the container so that the level drops below the surface of the heater cable causing an overheat condition, the increase in temperature of the heater cable jacket is sensed by the thermocouple. This causes controller 176 to de-energize relay coil 214 and break the power connection to the heater cable.

It should be evident that a pressure sensor could be used without benefit of purge fluid flow. In this application, pressure alone would operate the pressure sensor indicating a sound tubular heater jacket. In the event of pressure loss, the pressure sensor would signal a failure of the tubular heater jacket alerting the user prior to catastrophic failure.

As mentioned, the purpose for employing a metal sheath 30 is because the heater cable A needs to be grounded in order to obtain Underwriters Laboratories (UL) or Canadian Standards Association (CSA) approval.

In all of the embodiments illustrated, multiple parallel passages are provided between the sheath and the jacket to allow the flow of a purge fluid between the grounded heater sheath and the outer protective non-conductive tubular jacket. It should be appreciated that there are a variety of still further methods which could produce such a heater element. It is intended that all of these methods be included in the scope of this patent application, and the claims thereof.

The invention has been described with reference to several preferred embodiments. Obviously, modifications and alterations will occur to others upon the reading and understanding of this specification. It is intended to include all such modifications and alterations insofar as they come within the scope of the appended claims or the equivalents thereof.

What is claimed is:

1. An immersion heater for corrosive fluids, comprising:

an electrically resistive material strand operative upon connection to a source of power to provide heat;

a thermally conductive electrically insulating fill material disposed around said electrically resistive material strand;

an electrically conductive sheath disposed around said fill material;

a tubular jacket of a flexible chemically inert material encasing said electrically conductive sheath; and, a fluid flow passage defined between said tubular jacket and said sheath for allowing a fluid to flow therethrough.

2. The heater of claim 1 wherein said fluid flow passage is comprises a first helically extending channel.

3. The heater of claim 2 wherein said fluid flow passage further comprises a second helically extending channel which intersects said first helically extending channel, wherein said first and second channels spiral in opposite directions.

4. The heater of claim 3 wherein said first and second channels are located on an outer periphery of said electrically conductive heater element.

5. The heater of claim 1 wherein said fluid flow passage comprises at least one channel located on a knurled outer periphery of said electrically conductive sheath.

6. A purged grounded immersion heater for corrosive fluids, comprising:

an electrically resistive material strand operative upon connection to a source of power to provide heat;

a thermally conductive electrically insulating fill material disposed around said electrically resistive material strand;

an electrically conductive sheath disposed around said fill material;

a tubular jacket of a flexible chemically inert material encasing said electrically conductive sheath;

a passage means for allowing a fluid to flow between said tubular jacket and said electrically conductive sheath; and a heat transfer means for transferring heat between said sheath and said tubular jacket.

7. The heater of claim 6 wherein said passage means comprises at least one channel.

8. The heater of claim 7 wherein said at least one channel comprises a groove defined in an outer surface of said sheath.

9. The heater of claim 7 wherein said at least one channel comprises a valley defined in an inner surface of said jacket.

10. An immersion heating apparatus comprising:

a flexible cable-type immersion heater for immersion in a corrosive liquid, comprising:

an electrically resistive material strand operative upon connection to a source of power to provide heat, a thermally conductive electrically insulating fill material disposed around said electrically resistive material strand, an electrically conductive sheath disposed around said fill material, a tubular jacket of a flexible chemically inert material encasing said electrically conductive sheath, and a fluid flow passage defined between said tubular jacket and said sheath for allowing a fluid to flow therethrough;

a source of a purge fluid medium; and, a conduit for connecting said source of purge fluid medium to said fluid flow passage.

11. The heater of claim 10 wherein said fluid flow passage comprises:

a first helically extending channel defined in an outer surface of said sheath; and a second helically extending channel defined in an outer surface of said sheath, wherein said second helically extending channel intersects said first helically extending channel and wherein said first and second channels spiral in opposite directions.

12. The heater of claim 10 wherein said fluid flow passage comprises at least one groove defined in an outer surface of said sheath.

13. The heater of claim 10 wherein said fluid flow passage comprises at least one valley defined in an inner surface of said jacket.

14. The heater of claim 10 further comprising a braid layer located between said tubular jacket and said electrically conductive sheath, wherein said braid layer cooperates with said tubular jacket and said sheath to define said fluid flow passage.

* * * * *